US009035529B2

(12) United States Patent
Mok et al.

(10) Patent No.: US 9,035,529 B2
(45) Date of Patent: May 19, 2015

(54) COMMUTATOR HAVING A PLURALITY OF COMMUTATOR SEGMENTS AND METHOD FOR MAKING THE SAME

(75) Inventors: Raven Wai Kei Mok, Hong Kong (CN); Zhi Yang Yao, Hong Kong (CN); Xiao Jun Yang, Shenzhen (CN); Chung Fai Choi, Hong Kong (CN); Wilfried Gorlt, Baden-Württemberg (DE); James Ching Sik Lau, Hong Kong (CN); Alan Kin Fung Man, Hong Kong (CN); Kui Man Lai, Hong Kong (CN)

(73) Assignee: Johnston Electric S.A., Murten (CH)

( * ) Notice: Subject to any disclaimer, the term of this patent is extended or adjusted under 35 U.S.C. 154(b) by 348 days.

(21) Appl. No.: 13/181,063

(22) Filed: Jul. 12, 2011

(65) Prior Publication Data

US 2012/0007467 A1 Jan. 12, 2012

(30) Foreign Application Priority Data

Jul. 12, 2010 (CN) ..... 2010 1 0225799

(51) Int. Cl.

| | |
|---|---|
| ***H01R 39/06*** | (2006.01) |
| ***H01R 39/04*** | (2006.01) |
| ***H01R 39/32*** | (2006.01) |
| ***H01R 43/06*** | (2006.01) |

(52) U.S. Cl.

CPC ..... *H01R 43/06* (2013.01); *H01R 39/06* (2013.01)

(58) Field of Classification Search

CPC ..... H02K 13/04; H01R 39/00; H01R 39/06
USPC ..... 310/233–237; 29/596–597
See application file for complete search history.

(56) References Cited

U.S. PATENT DOCUMENTS

| | | | | |
|---|---|---|---|---|
| 1,457,801 | A * | 6/1923 | Van Dusen | 310/237 |
| 3,717,511 | A * | 2/1973 | Wallbaum | 148/680 |
| 4,290,191 | A * | 9/1981 | Klein | 29/597 |
| 5,386,167 | A | 1/1995 | Strobi | |
| 5,442,849 | A | 8/1995 | Strobl | |
| 5,629,576 | A | 5/1997 | Shimoyama | |
| 5,898,989 | A | 5/1999 | Strobl | |
| 6,445,103 | B2 | 9/2002 | Moss et al. | |
| 6,634,082 | B1 * | 10/2003 | Ziegler et al. | 29/597 |
| 2009/0179519 | A1 * | 7/2009 | Poon | 310/237 |
| 2010/0314966 | A1 * | 12/2010 | Gorlt | 310/234 |

FOREIGN PATENT DOCUMENTS

| | | |
|---|---|---|
| CN | 1391319 | 1/2003 |
| CN | 1558475 | 12/2004 |
| CN | 1694316 | 11/2005 |

(Continued)

*Primary Examiner* — Jose Gonzalez Quinones
(74) *Attorney, Agent, or Firm* — Muncy, Geissler, Olds & Lowe, P.C.

(57) ABSTRACT

A commutator has a plurality of commutator segments fixed to an insulating support member. The commutator segments are formed by cold or hot forming a copper billet cut from a length of copper wire. Each billet has a volume approximately equal to the volume of one commutator segment. Each commutator segment has a main body and an anchor integrally formed with the main body. The commutator segments are spaced about a circle and then an insulating support member is molded to the commutator segments to fix the commutator segments to the support member.

14 Claims, 3 Drawing Sheets

(56) References Cited

FOREIGN PATENT DOCUMENTS

| | | | | |
|---|---|---|---|---|
| JP | 56010048 | A | | 2/1981 |
| JP | 59061451 | A | * | 4/1984 |
| JP | 3040738 | | | 2/1991 |
| JP | 03040738 | A | * | 2/1991 |

* cited by examiner

COMMUTATOR HAVING A PLURALITY OF COMMUTATOR SEGMENTS AND METHOD FOR MAKING THE SAME

CROSS REFERENCE TO RELATED APPLICATIONS

This non-provisional patent application claims priority under 35 U.S.C. §119(a) from Patent Application No. 201010225799.6 filed in The People's Republic of China on Jul. 12, 2010.

FIELD OF THE INVENTION

This invention relates to a commutator for an electric motor and to a method of making the commutator.

BACKGROUND OF THE INVENTION

A commutator comprises an insulating support member and a plurality of conductive commutator segments supported by the support member. Each commutator segment comprises a main body and an anchor for fixing the main body to the support member. The main body has a surface for making contact with motor brushes and a tang or terminal for the connection of rotor windings. The brush contact surface may or may not be covered by a special brush contacting material such as a graphite or carbon layer soldered to the main body.

A traditional method of making a flat type commutator comprises the following steps: making a set of commutator segments that are formed as one single copper piece; molding an insulating support member on the copper piece; cutting the copper piece and the graphite ring into a plurality of commutator segments. There is an optional step of soldering a graphite ring to the copper piece and cutting the graphite ring with the copper piece. There is material wastage or scrap because of forming a set of commutator segments as one single copper piece and cutting the copper piece into commutator segments.

Further more, the metallurgical structure of the commutator segments is usually disrupted. A portion of metal flow terminates at the portions where a change in the size of the cross section varies. This affects the strength of the commutator segment. Therefore, there is a desire for an improved commutator having less material wastage and optionally has greater strength.

SUMMARY OF THE INVENTION

Accordingly, in one aspect thereof, the present invention provides a method of making a commutator having a plurality of commutator segments fixed to an insulating support member, the method comprising the steps of: providing a plurality of copper billets, each billet having a volume approximately equal to the volume of one commutator segment; forming each copper billet into a commutator segment having a main body and at least one anchor integrally formed with the main body; arranging the commutator segments spaced about a circle; and molding an insulating support member to the arranged commutator segments to fix the commutator segments to the support member.

Preferably, the step of forming each copper billet is a cold forming treatment.

Preferably, the cold forming treatment comprises cold heading and/or cold forging.

Alternatively, the forming step is a hot forming treatment.

Preferably, the anchor is a projection located on one surface of the main body.

Preferably, the projection is slit to form the anchor into a V shape.

Alternatively, the projection is formed inclined to the main body.

Preferably, the method comprises bending one end of the main body to form a tang.

Preferably, the step of arranging the formed commutator segments about a circle comprises soldering the commutator segments to a graphite ring; and after molding the insulating support member, dividing the graphite ring into a plurality of graphite sectors, each graphite sector being fixed with one corresponding commutator segment.

Alternatively, the step of arranging the commutator segments spaced about a circle includes soldering a graphite sector to each commutator segment.

Preferably, the step of providing a plurality of copper billets includes cutting the copper billets from a length of copper wire.

In a second aspect thereof, the present invention provides a commutator comprising an insulating support member and a plurality of commutator segments fixed to the support member, each commutator segment comprising a main body and an integrally formed anchor, the anchor being embedded within and locked to the support member, one end of the main body being arranged for connecting to the windings, wherein each commutator segment is made from a single copper billet by a forming process.

Preferably, in the metallurgical structure of the commutator segments at the portion where the size of the cross section varies, substantially all of the metal flow is continuous.

Preferably, in the metallurgical structure of the commutator segments at the portion where the anchor joins the main body, substantially all of the metal flow is continuous.

Preferably, the anchor is offset from the edge of the main body.

By implementing the present invention, the commutator segment is made from one copper billet by a forming treatment such as cold forming or hot forming. There is less wastage of copper material. Furthermore, the metal flow of the metallurgical structure of the commutator segment is more continuous than the metal flow of the traditional commutator segment. Therefore, the strength of the commutator segment is also improved.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

A method of making a motor commutator according to a first preferred embodiment will be described with reference to FIG. 1 to FIG. 6. In this embodiment, the commutator is a flat type commutator (FIG. 6), comprising an insulating support member 17 and a plurality of commutator segments fixed to the support member 17.

Figure 1:
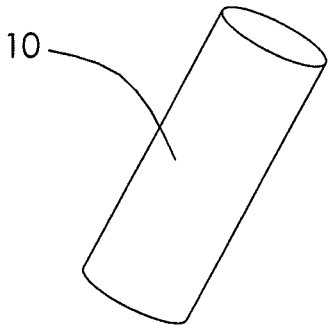
FIG. 1 illustrates a copper billet according to a preferred embodiment of the present invention.

FIG. 1 illustrates a copper billet 10 that is used to form one commutator segment. The copper billet 10 is formed by chopping a strip-shaped commutator material, such as a copper rod or copper wire. The volume of each copper billet 10 is approximately equal to the volume of one commutator segment, since each copper billet makes one commutator segment. Preferably, each copper billet 10 is cylindrical.

Figure 2:
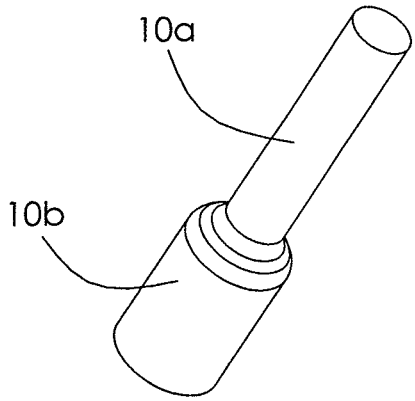
FIG. 2 illustrates a cold headed copper billet.

The copper billet 10 of FIG. 1 is subjected to a cold heading treatment to produce a cold headed copper billet as shown in FIG. 2. The cold headed copper billet comprises a smaller cylindrical portion 10*a* and a bigger cylindrical portion 10*b*. The smaller cylindrical portion 10*a* and the bigger cylindrical portion 10*b* are integrally formed (monolithic structure). Preferably, the cylindrical portions 10*a* and 10*b* are coaxial.

Figure 3:
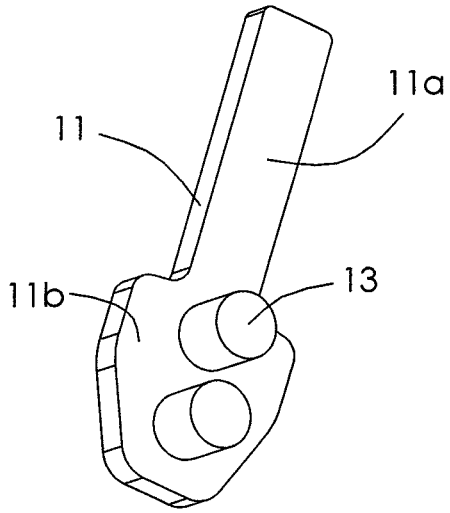
FIG. 3 illustrates a cold headed and cold formed copper billet.

The cold headed copper billet of FIG. 2 is further subjected to a cold forging treatment. The cold forging treatment shapes the copper billet into a commutator segment as shown in FIG. 3. The commutator segment comprises a sheet like main body 11 and two integrally formed anchors 13. The anchors 13 are rod-shaped, substantially perpendicular to the sheet like main body 11. The main body 11 comprises a narrower portion 11*a* and a wider portion 11*b*. The narrower portion 11*a* and the wider portion 11*b* correspond to the smaller cylindrical portion 10*a* and the bigger cylindrical portion 10*b*, respectively. Since the anchors 13 are formed by cold forging, it is possible to form the anchors 13 at a position offset from the edge of the wider portion. Preferably, the anchors 13 are arranged at the center of the wider portion 11*b*.

Figure 4:
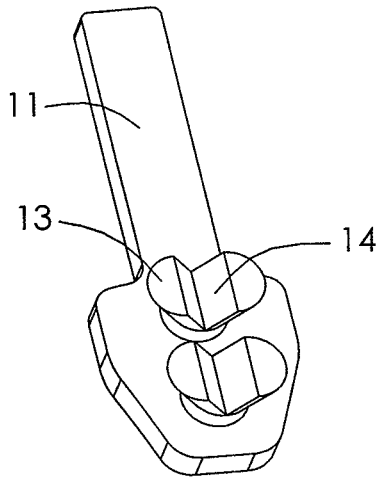
FIG. 4 illustrates a commutator segment formed by the copper billet of FIG. 3.

Referring to FIG. 4, a split 14 is formed in each anchor 13. Each anchor 13 is deformed by the split 14 into a V shape. The V-shaped anchors 13 allows the commutator segment to be firmly fixed to the support member 17 (FIG. 6) in an interlocking manner, when the anchors are embedded into the support member. A person skilled in the art would recognize that there are alternative solutions for making the commutator segments interlock with the support member 17. For instance, an interlock structure could be formed by making the rod-shaped anchors 13 inclined to the wider portion 11*b*, or making the two rod-shaped anchors 13 inclined to form a "V".

Figure 5:
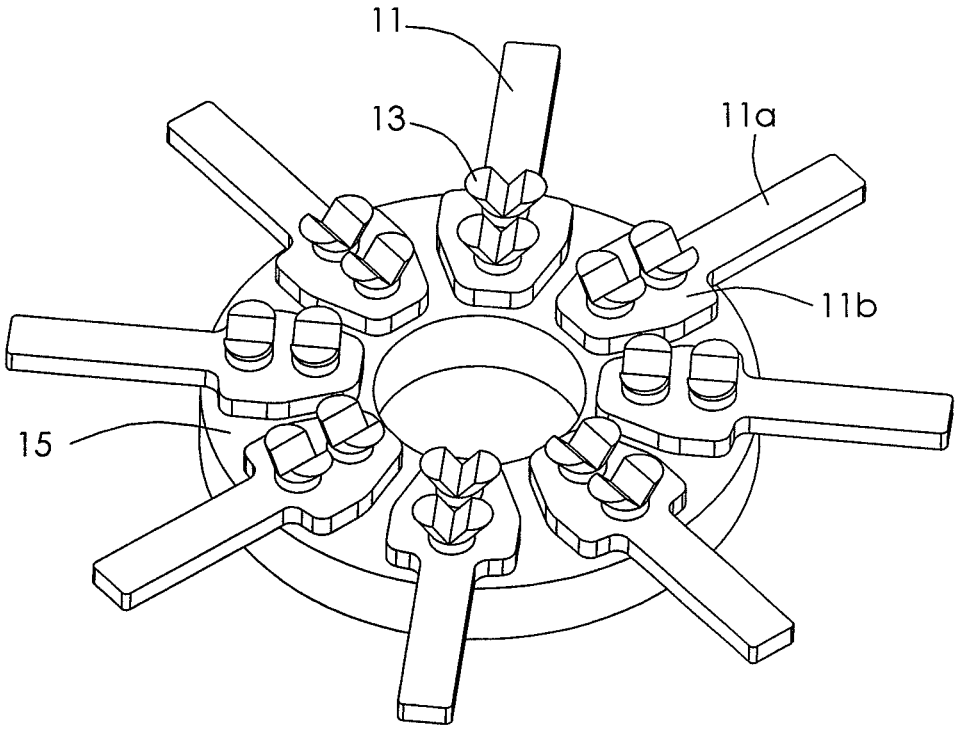
FIG. 5 illustrates a graphite ring and a plurality of commutator segments arranged along the graphite ring.

Referring to FIG. 5, a plurality of commutator segments of FIG. 4 are fixed to a graphite ring 15 by soldering. The commutator segments are arranged on one side of the graphite ring 15. The commutator segments are equally spaced about a circle. The wider portions 11*b* touch the graphite ring 15, while the narrower portions 11*b* radially extend out from the graphite ring 15.

Figure 6:
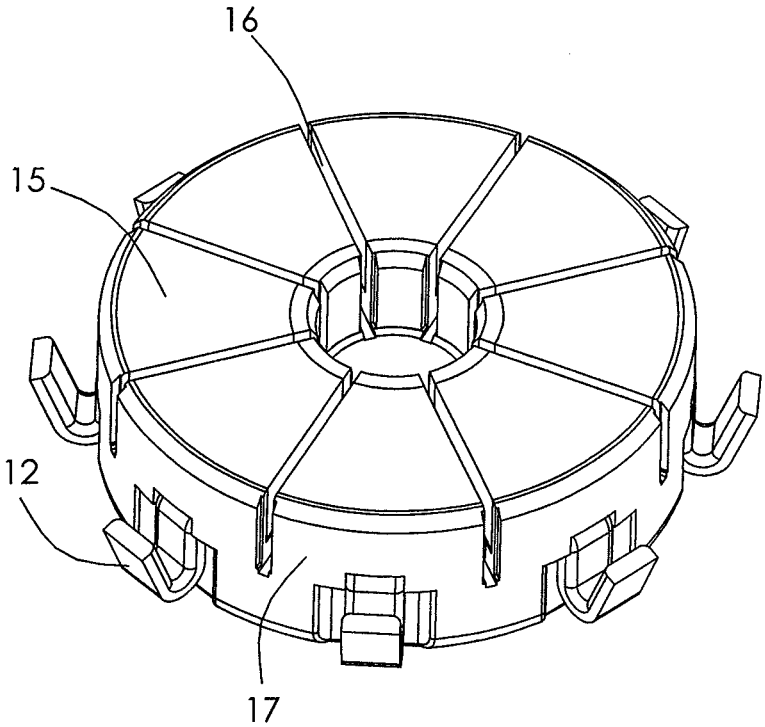
FIG. 6 illustrates a flat type graphite commutator.

Referring to FIG. 6, an insulating support member 17 is molded to the graphite ring 15, preferably by injection molding. Preferably, the support member embeds the commutator segment and may cover the sides of the graphite ring, leaving at least one surface of the ring free. The anchors 13 and the wider portions 11*b* of the commutator segments are embedded in the support member 17. The graphite ring 15 is then divided into a plurality of separate graphite sectors by a plurality of grooves 16. The graphite sectors are insulated from each other by the grooves 16. Each sector is fixed with one respective commutator segment. The radially extending narrow portions 11*a* are then bent into hook portions forming tangs 12 for connection of rotor windings.

Alternatively, the graphite ring 15 is replaced by a copper ring. In other words, a plurality of commutator segments of FIG. 4 are soldered to a copper ring rather than a graphite ring 15. The copper ring is divided into a plurality of copper sectors. In a further alternative embodiment, neither copper ring nor graphite ring is used. A flat commutator according to the embodiment only comprises the copper commutator segments formed by cold forming and the support member 17 formed by injection molding.

In the above embodiments, each commutator segment is formed by one copper billet by a cold forming treatment. There is little or no wastage of copper material. Alternatively, each commutator segment is formed by one copper billet by hot forming treatment, such as hot heading and hot forging. There is also little or no wastage of copper material by using hot forming treatment.

Figure 7:
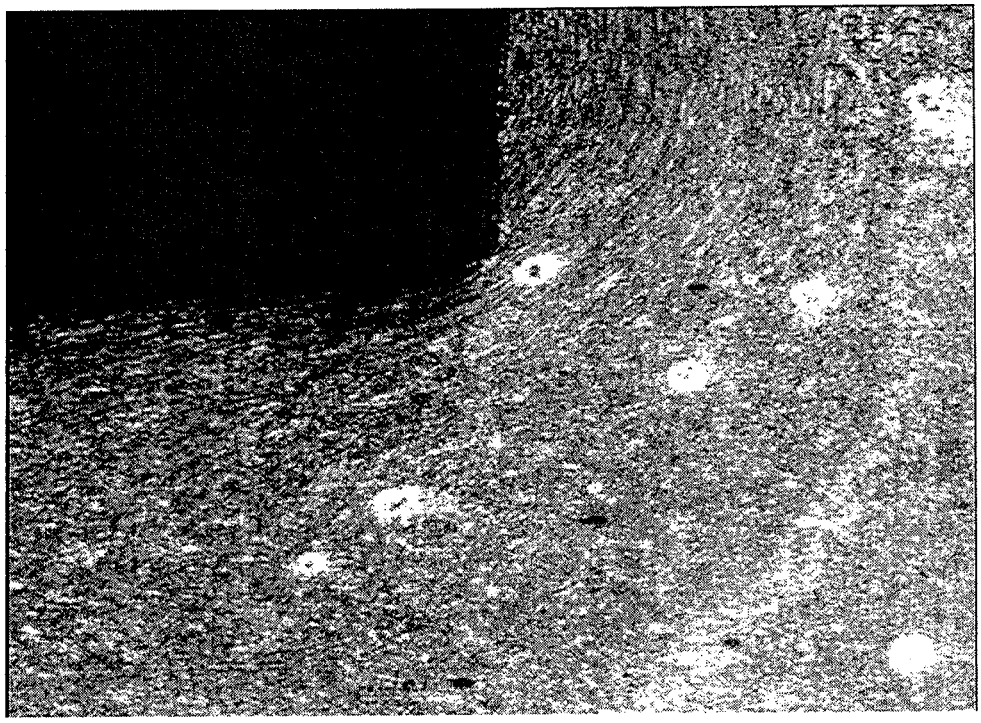
FIG. 7 illustrates a metallographic photo of a part of the commutator segment of FIG. 4.

In addition, the metallurgical structure of the commutator segments is not disrupted. The metal flow is continuous even at the portions where the size of the cross section varies. Thus improving the strength of the commutator segment. FIG. 7 illustrates the metallurgical structure of the commutator segment at the position where the narrower portion 11*a* joins the wider portion 11*b*. Although the size of the cross section varies at this position, substantially all of the metal flow is substantially continuous. Therefore, the strength is improved. While in traditional commutator segment, quite a few metal flow terminated at the portion where the size of the cross section varies.

Figure 8:
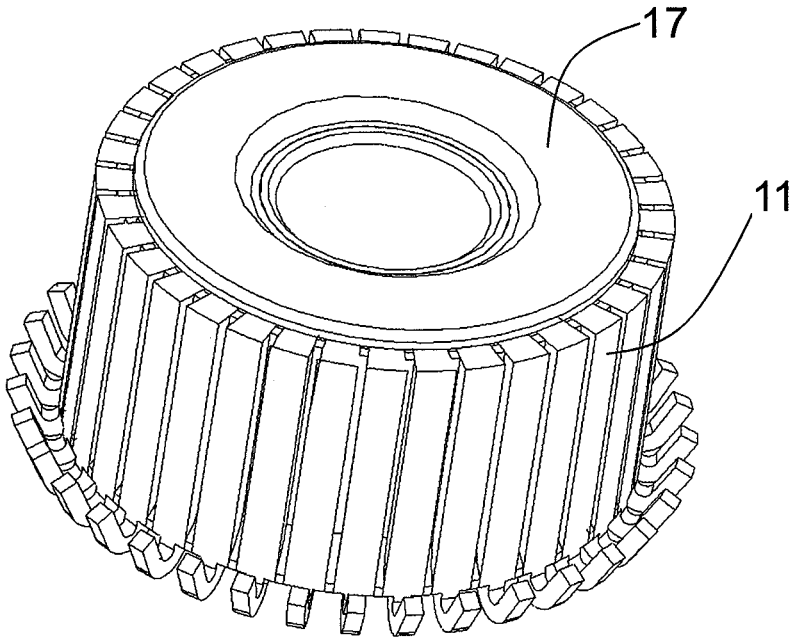
FIG. 8 illustrates a barrel type commutator according to another preferred embodiment of the present invention.

FIG. 8 illustrates a barrel type motor commutator that comprises a cylindrical insulating support member 17 and a plurality of commutator segments fixed to the support member 17. The barrel type commutator is made according to the following process.

A strip shaped copper material is cut into a plurality of copper billets. The volume of each copper billet is approximately equal to the volume of one commutator segment.

Each copper billet is made into a commutator segment by cold forming. The commutator segment comprises a main body and at least one anchor that is integrally formed with the main body. Preferably, each anchor is split to form a "V" shaped inter-lock structure.

The commutator segments are in a circle and fixed in a mold. A cylindrical support member 17 is then molded to the commutator segments by injection molding. The anchors 13 of each commutator segment is embedded and inter locked with the support member 17. Each commutator segment has an end portion that is bent to form a tang or hook for connection of the windings.

In the description and claims of the present application, each of the verbs "comprise", "include", "contain" and "have", and variations thereof, are used in an inclusive sense, to specify the presence of the stated item but not to exclude the presence of additional items.

Although the invention has been described with reference to one or more preferred embodiments, it should be appreciated by those skilled in the art that various modifications are possible. Therefore, the scope of the invention is to be determined by reference to the claims that follow.

The invention claimed is:

1. A method of making a commutator having a plurality of commutator segments fixed to an insulating support member, the method comprising the steps of:

providing a plurality of copper billets;

providing a cold heading treatment to each copper billet to form a cold headed copper billet, each cold headed copper billet having a first portion at one axial end and a second portion at the other axial end, the first portion has a diameter smaller than the second portion;

pressing each cold headed copper billet into a commutator segment having a main body and at least one anchor integrally formed with the main body;

soldering the commutator segments to a conductive ring so that the commutator segments are spaced about a circle;

molding an insulating support member to the arranged commutator segments to fix the commutator segments to the support member; and dividing the conductive ring into a plurality of graphite sectors, each graphite sector being fixed with one corresponding commutator segment.

2. The method of claim 1, wherein the step of pressing each copper billet includes performing a cold forming treatment.

3. The method of claim 2, the cold forming treatment comprises performing cold heading and/or cold forging.

4. The method of claim 1, wherein the pressing step includes performing a hot forming treatment.

5. The method of claim 1, wherein the pressing step includes forming a projection as the anchor on one surface of the main body.

6. The method of claim 5, wherein the pressing step further comprises splitting the projection to form the anchor into a V-shaped projection.

7. The method of claim 5, wherein the pressing step further comprises forming the projection inclined to the main body.

8. The method of claim 1, further comprising bending one end of the main body corresponding to the first portion to form a tang.

9. The method of claim 1, wherein the step of providing a plurality of copper billets includes cutting the copper billets from a length of copper wire.

10. The method of claim 1, wherein the step of soldering the commutator segments to a conductive ring comprises forming a first space in the circumferential direction between main bodies of adjacent commutator segments; the step of dividing the conductive ring into a plurality of sectors comprises forming a second space in the circumferential direction between adjacent sectors, the second space is smaller than the first space.

11. The method of claim 1, wherein the step of soldering the commutator segments to a conductive ring comprises forming a space having an uneven width along a radial direction of the commutator in the circumferential direction between main bodies of adjacent commutator segments.

12. The method of claim 11, wherein the step of soldering the commutator segments to a conductive ring further comprises forming the width of the middle of the space to be smaller than that of the radial outer end of the space.

13. A method of making a commutator having a plurality of commutator segments fixed to an insulating support member, the method comprising the steps of:

providing a plurality of copper billets;

providing a cold heading treatment to each copper billet to form a cold headed copper billet, each cold headed copper billet having a first portion at one axial end and a second portion at the other axial end, the first portion has a diameter smaller than the second portion;

pressing each cold headed copper billet into a commutator segment having a main body and at least one anchor integrally formed with the main body, the main body having a narrower portion formed by the first portion and a wider portion formed by the second portion; and molding an insulating support member to the arranged commutator segments to fix the commutator segments to the support member.

14. The method of claim 13, wherein the step of providing a plurality of copper billets comprises a step of providing a cylindrical copper rod or copper wire, and a step of cutting the copper rod or copper wire into a plurality of individual copper billets.

* * * * *